US009311857B2

(12) United States Patent
Seong et al.

(10) Patent No.: US 9,311,857 B2
(45) Date of Patent: Apr. 12, 2016

(54) ORGANIC LIGHT EMITTING DIODE DISPLAY AND METHOD FOR DRIVING THE SAME

(71) Applicant: LG Display Co., Ltd., Seoul (KR)

(72) Inventors: Woo-Ram Seong, Gyeonggi-do (KR); Seong-Gyun Kim, Gyeonggi-do (KR)

(73) Assignee: LG DISPLAY CO., LTD., Seoul (KR)

( * ) Notice: Subject to any disclaimer, the term of this patent is extended or adjusted under 35 U.S.C. 154(b) by 226 days.

(21) Appl. No.: 13/944,680

(22) Filed: Jul. 17, 2013

(65) Prior Publication Data

US 2014/0152717 A1 Jun. 5, 2014

(30) Foreign Application Priority Data

Dec. 4, 2012 (KR) ..... 10-2012-0139597

(51) Int. Cl.
*G09G 3/32* (2006.01)

(52) U.S. Cl.
CPC ..... *G09G 3/3275* (2013.01)

(58) Field of Classification Search
CPC ..... G09G 3/3275; G09G 2320/043; G09G 2320/048; G09G 2300/0809; G09G 3/3266; G09G 2300/0861; G09G 2310/027; G09G 3/2014; G09G 2320/029; G09G 2320/0285; G09G 2310/0262; G09G 3/3291; G09G 3/3225
USPC ..... 345/76–83, 204–214, 690–694
See application file for complete search history.

(56) References Cited

U.S. PATENT DOCUMENTS

| | | | | |
|---|---|---|---|---|
| 2003/0063053 | A1* | 4/2003 | Yamazaki et al. | 345/82 |
| 2007/0057959 | A1 | 3/2007 | Cho et al. | |
| 2007/0132683 | A1 | 6/2007 | Kong | |
| 2008/0284691 | A1* | 11/2008 | Chung et al. | 345/76 |

FOREIGN PATENT DOCUMENTS

| | | | |
|---|---|---|---|
| CN | 1928961 | A | 3/2007 |
| CN | 101083065 | A | 12/2007 |
| CN | 101097319 | A | 1/2008 |
| CN | 101097684 | A | 1/2008 |

* cited by examiner

*Primary Examiner* — Vijay Shankar
*Assistant Examiner* — Abhishek Sarma
(74) *Attorney, Agent, or Firm* — Dentons US LLP

(57) ABSTRACT

Disclosed are an organic light emitting diode (OLED) display device and a method for driving the same, which are capable of minimizing required memory capacity and the use rate thereof while achieving an enhancement in display quality through execution of an overdriving (or accelerated driving) in accordance with image information of plural accumulated frames. The OLED display device includes a data modulator for sequentially receiving image data of a current frame from a timing controller, counting a number of accumulations of pixels corresponding to image data having a lower grayscale value than a grayscale value of predetermined reference data, generating modulated image data through application of a weight determined in accordance with the counted accumulation number, and supplying the modulated image data to a data driver.

8 Claims, 6 Drawing Sheets

ORGANIC LIGHT EMITTING DIODE DISPLAY AND METHOD FOR DRIVING THE SAME

This application claims the benefit of the Korean Patent Application No. 10-2012-0139597, filed on Dec. 4, 2012 which is hereby incorporated by reference as if fully set forth herein.

BACKGROUND OF THE INVENTION

1. Field of the Invention

The present invention relates to an organic light emitting diode (OLED) display device, and, more particularly, to an OLED display device and a method for driving the same, which are capable of minimizing required memory capacity and the use rate thereof while achieving an enhancement in display quality through execution of overdriving (or accelerated driving) in accordance with image information of plural accumulated frames.

2. Discussion of the Related Art

Among flat panel display devices, which are presently an area of great interest, there are a liquid crystal display (LCD) device, a field emission display (FED) device, a plasma display panel (PDP) device, an organic light emitting diode (OLED) display device, etc. Among such flat panel display devices, the OLED display device is usefully applied to mobile communication appliances such as smartphones or tablet computers because it exhibits high brightness, and employs a low drive voltage while having an ultra-slim structure.

Such an OLED display device includes a plurality of pixels. Each pixel includes an OLED pixel including an anode, a cathode, an organic light emitting layer formed between the anode and the cathode, and a pixel circuit for independently driving the OLED pixel. The OLED display device also includes a driving control circuit for driving respective pixel circuits of the pixels.

In the OLED display device, a predetermined reference gamma voltage is sub-divided into gamma voltages for different grayscales. Using the sub-divided gamma voltages for different grayscales, digital data is converted into analog data signals (current or voltage signals). The analog data signals are supplied to respective pixel circuits, to enable an image to be displayed through the OLED pixels.

In order to reduce pixel response time, some conventional OLED display devices or LCD devices employ an overdriving (or accelerated driving) method in which image data is displayed in a modulated state. In the conventionally-employed overdriving method, image data of a current frame and image data of a previous frame are compared with each other, to set a degree of overdriving in accordance with an image data difference between frames and the set overdriving degree is then applied.

In such OLED display devices, however, it is necessary to set a degree of overdriving and to apply the set overdriving degree, taking into consideration image data of several previous frames, because the OLED display device has response characteristics influenced by accumulated image data, unlike LCD devices. Since the OLED display device is influenced by image data of several accumulated frames, degradation of picture quality such as over-shoot or under-shoot due to excessive or insufficient overdriving degree when the degree of overdriving is set and applied in accordance with image data of a most recent frame, may be encountered To this end, in the OLED display device, a degree of overdriving must be set and the set overdriving degree must be applied, taking into consideration image data of several previously accumulated frames. However, excessively large memory capacity and excessively-increased memory use rate are required in order to store image data accumulated for several frames. For this reason, in applying the overdriving method to the OLED display device, many hardware problems must be taken into consideration.

SUMMARY OF THE INVENTION

Accordingly, the present invention is directed to an organic light emitting diode display device and a method for driving the same that substantially obviates one or more problems due to limitations and disadvantages of the related art.

An advantage of the present invention is to provide an organic light emitting diode (OLED) display device and a method for driving the same, which are capable of minimizing required memory capacity and the use rate thereof while achieving an enhancement in display quality through execution of overdriving (or accelerated driving) in accordance with image information of plural accumulated frames.

Additional advantages, and features of the invention will be set forth in part in the description which follows and in part will become apparent to those having ordinary skill in the art upon examination of the following or may be learned from practice of the invention. The advantages of the invention may be realized and attained by the structure particularly pointed out in the written description and claims hereof as well as the appended drawings.

To achieve these advantages and in accordance with the purpose of the invention, as embodied and broadly described herein, an organic light emitting diode display device includes an image display panel including a plurality of pixel regions, a data driver for driving data lines of the image display panel, a timing controller for arranging image data input from outside of the device to match a size of the image display panel, and generating a data control signal to control the data driver, and a data modulator for sequentially receiving image data of a current frame from the timing controller, counting a number of accumulations of pixels corresponding to image data having a lower grayscale value than a grayscale value of predetermined reference data, generating modulated image data through application of a weight determined in accordance with the counted accumulation number, and supplying the modulated image data to the data driver.

The data modulator may include a look-up table for comparing the image data supplied from the timing controller with image data of a previous frame, and outputting a compensation value corresponding to a difference between the image data from the timing controller and the image data of the previous frame in units of at least one pixel, a weight controller for comparing the image data supplied from the timing controller with the predetermined reference data in units of at least one pixel, counting an input number of low-grayscale image data having a lower grayscale value than the grayscale value of the predetermined reference data, and outputting a weight set to correspond to the counted number on a per pixel basis, a multiplier for multiplying compensation values sequentially output from the look-up table by corresponding ones of weights output from the output controller, thereby sequentially outputting weight data, and an adder for sequentially adding the weight data sequentially output from the multiplier to the image data of the current frame, to modulate the image data of the current frame, and supplying the modulated image data to the data driver.

The weight controller may compare the image data of the current frame with the predetermined reference data in units of at least one of one pixel, a pixel block having "n×m" pixels, pixels at a predetermined position, and a predetermined particular pattern, may count a number of accumulations of low-grayscale image data having a lower grayscale value than the grayscale value of the predetermined reference data, and may output a weight corresponding to the counted number on a per pixel basis.

When the accumulation number of the image data having a lower grayscale value than the grayscale value of the predetermined reference data is increased, the weight may be set to have predetermined increments according to the increased accumulation number, for application of a high degree of overdriving compensation. When the accumulation number of low-grayscale image data is decreased or there is no accumulation of low-grayscale image data, the weight may be set to be maintained or to have predetermined decrements, for application of a low degree of overdriving compensation.

In another aspect of the present invention, a method for driving an organic light emitting diode display device includes driving data lines of an image display panel including a plurality of pixel regions, arranging image data input from outside of the device to match a size of the image display panel, and generating a data control signal to control a data driver, and sequentially receiving image data of a current frame, counting a number of accumulations of pixels corresponding to image data having a lower grayscale value than a grayscale value of predetermined reference data, generating modulated image data through application of a weight determined in accordance with the counted accumulation number, and supplying the modulated image data to the data driver.

The generating the modulated image data may include comparing the image data of the current frame with image data of a previous frame, outputting a compensation value corresponding to a difference between the image data of the current frame and the image data of the previous frame in units of at least one pixel, comparing the image data of the current frame with the predetermined reference data in units of at least one pixel, counting an input number of low-grayscale image data having a lower grayscale value than the grayscale value of the predetermined reference data, outputting a weight set to correspond to the counted number on a per pixel basis, multiplying sequentially-output compensation values by corresponding ones of weights output on a per pixel basis, thereby sequentially outputting weight data, and sequentially adding the sequentially-output weight data to the image data of the current frame, to modulate the image data of the current frame, and supplying the modulated image data to the data driver.

The outputting the weight on a per pixel basis may include comparing the image data of the current frame with the predetermined reference data in units of at least one of one pixel, a pixel block having "n×m" pixels, pixels at a predetermined position, and a predetermined particular pattern, counting a number of accumulations of low-grayscale image data having a lower grayscale value than the grayscale value of the predetermined reference data, and outputting a weight corresponding to the counted number on a per pixel basis.

When the accumulation number of the image data having a lower grayscale value than the grayscale value of the predetermined reference data is increased, the weight may be set to have predetermined increments according to the increased accumulation number, for application of a high degree of overdriving compensation. When the accumulation number of low-grayscale image data is decreased or there is no accumulation of low-grayscale image data, the weight may be set to be maintained or to have predetermined decrements, for application of a low degree of overdriving compensation.

In accordance with the OLED display device and the method for driving the same according to the above-described aspects of the present invention, it may be possible to minimize required memory capacity and the use rate thereof while achieving an enhancement in display quality through application of overdriving (or accelerated driving) compensation effects varied in accordance with image information of plural accumulated frames (for example, the number of accumulations of low-grayscale image data).

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and along with the description serve to explain the principle of the invention. In the drawings.

DETAILED DESCRIPTION OF THE INVENTION

Reference will now be made in detail to the embodiments of the present invention associated with an organic light emitting diode display device and a method for driving the same, examples of which are illustrated in the accompanying drawings.

Figure 1:
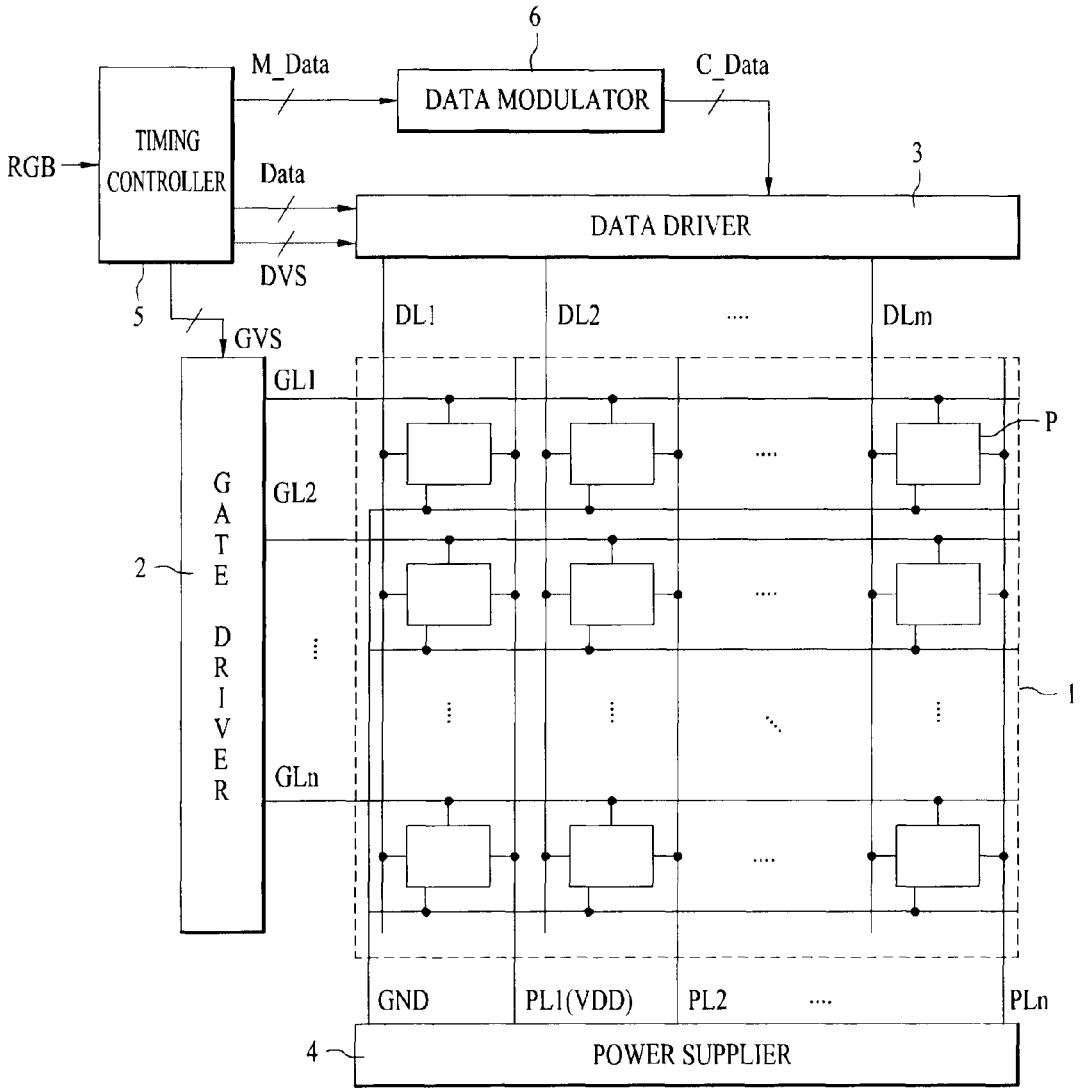
FIG. 1 illustrates an organic light emitting diode (OLED) display device according to an exemplary embodiment of the present invention.

FIG. 1 is a configuration diagram illustrating an organic light emitting diode (OLED) display device according to an exemplary embodiment of the present invention.

The OLED display device shown in FIG. 1 includes an image display panel 1 including a plurality of pixel regions, a gate driver 2 for driving gate lines GL1 to GLn of the image display panel 1, a data driver 3 for driving data lines DL1 to DLm of the image display panel 1, and a power supplier 4 for supplying first and second drive power signals VDD and GND to power lines PL1 to PLm of the image display panel 1. The OLED display device also includes a timing controller 5 for arranging image data RGB input from outside of the device to match the size of the image display panel 1, and generating gate and data control signals GVS and DVS to control the gate and data drivers 2 and 3, and a data modulator 6 for sequentially receiving image data M_Data from the timing controller 5, counting the number of accumulations of pixels corresponding to image data having a lower grayscale value than that of predetermined reference data, generating modulated image data through application of a weight determined in accordance with the counted accumulation number of low-grayscale image data, and supplying the modulated image data to the data driver 3.

The pixel regions of the display panel 1 are arranged in the form of a matrix, and a plurality of sub-pixels P is arranged in each pixel region, to display an image. Each sub-pixel P includes a light emitting diode, and a diode driving circuit for independently driving the light emitting diode. In detail, each sub-pixel P includes a diode driving circuit connected to one gate line GL, one data line DL, and one power line PL, and a light emitting diode connected between the diode driving circuit and the second power signal GND.

Each diode driving circuit supplies, to the light emitting diode connected thereto, an analog data signal from the data line DL connected to the diode driving circuit, to charge the light emitting diode with the analog data signal, and thus to maintain a light emission state of the light emitting diode.

The gate driver 2 sequentially generates gate-on signals in response to gate control signals GVS from the timing controller 5, for example, a gate start pulse (GSP) and a gate shift clock (GSC), while controlling the pulse width of each gate-on signal in accordance with a gate output enable (GOE) signal. The gate-on signals are sequentially supplied to respective gate lines GL1 to GLn. In this case, in a period in which no gate-on signal is supplied, a gate-off signal is supplied to each of the gate lines GL1 to GLn.

The data driver 3 converts modulated data Mdata modulated on a per frame basis by the data modulator 6 into an analog voltage, namely, an analog image signal, using a source start pulse (SSP) and a source shift clock (SSC) which are included in data control signals DVS from the timing controller 5. In response to a source output enable (SOE) signal, the data driver 3 also supplies the image signal to each of the data lines DL1 to DLm. In detail, the data driver 3 latches image data received in accordance with the SSC, and supplies an image signal corresponding to one horizontal line to each of the data lines DL1 to DLm at intervals of one horizontal period, that is, in every horizontal period in which a scan pulse is supplied to one of the gate lines GL1 to GLn, in response to the SOE signal.

The power supplier 4 supplies the first and second power signals VDD and GND to the image display panel 1. Here, the first power signal VDD means a drive voltage to drive the light emitting diode, whereas the second power signal GND means a ground voltage or a low voltage. Due to a difference between the first power signal VDD and the second power signal GND, current corresponding to an image signal may flow through each sub-pixel P.

The timing controller 5 arranges RGB data received from outside, to match driving of the image display panel 1, and supplies the arranged image data, to the data modulator 6. The timing controller 5 also generates the gate and data control signals GVS and DVS, using synchronization signals MCLK, DE, Hsync and Vsync received from outside, and supplies the gate and data control signals GVS and DVS to the gate driver 2 and the data driver 3, respectively.

The data modulator 6 compares currently-input image data M_Data with predetermined reference data in units of at least one pixel or in units of a predetermined number of pixels or at least one pattern having influence on image display characteristics of a current frame. The data modulator 6 counts the number of accumulations (number of inputs) of pixels of image data having a lower grayscale value than that of the predetermined reference data, and generates a weight in accordance with the result count.

When the accumulation number of low-grayscale input image data having a lower grayscale value than that of the predetermined reference data, that is, the counted value of the input image data, is increased, the input image data may have increased influence on the image display characteristics of the current frame. Generally, when the display time of an image having a grayscale value close to black series which are low grayscales is increased, the display luminance of high-grayscale (high luminance) data in a next frame may be decreased due to the characteristics of the OLED panel. To this end, the data modulator 6 modulates image data through application of a weight determined in accordance with the accumulation number of low-grayscale image data, namely, the counted value of low-grayscale image data, to the image data on a per frame basis, in order to more reliably exhibit overdriving effects. The data modulator 6 then supplies the modulated image data to the data driver 3.

Weights corresponding to various accumulation numbers of low-grayscale image data are previously set in the data modulator 6. When the input number of image data having a lower grayscale value than that of the predetermined reference data is increased, the weight to be applied to the image data is set to a higher value than that of the weight applied in the previous frame, in order to increase overdriving compensation. On the other hand, when the input number of image data having a lower grayscale value than that of the predetermined reference data is decreased or there is no image data having a lower grayscale value than that of the predetermined reference data, the weight to be applied to the image data is set to a value lower than or equal to that of the weight applied in the previous frame, in order to decrease or maintain the degree of overdriving compensation.

Figure 2:
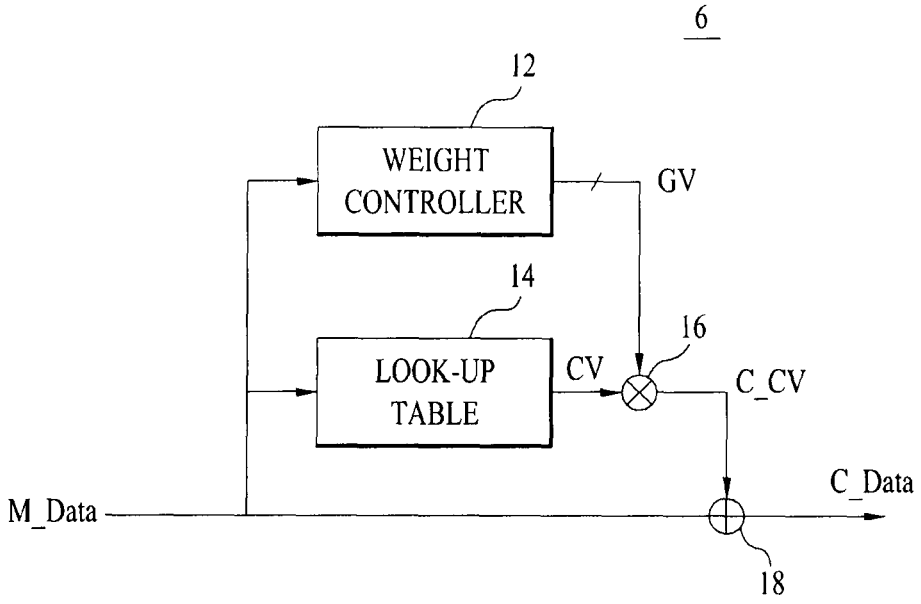
FIG. 2 is a configuration diagram illustrating, in detail, a data modulator illustrated in FIG. 1.

FIG. 2 illustrates, in detail, the data modulator illustrated in FIG. 1.

The data modulator 6 illustrated in FIG. 2 includes a look-up table 14 for comparing image data M_Data supplied from the timing controller 5 with image data of a previous frame, and outputting a compensation value CV corresponding to a difference between the image data M_Data and the image data of the previous frame in units of at least one pixel, and a weight controller 12 for comparing the image data M_Data supplied from the timing controller 5 with the predetermined reference data in units of at least one pixel, counting the input number of low-grayscale image data having a lower grayscale value than that of the predetermined reference data, and outputting a weight GV set to correspond to the counted value, namely, the accumulation number of the low-grayscale image data, on a per pixel basis. The data modulator 6 also includes a multiplier 16 for multiplying compensation values CV sequentially output from the look-up table 14 by corresponding ones of weights GV output from the output controller 12, thereby sequentially outputting weight data C_CV, and an adder 18 for sequentially adding the weight data C-CV sequentially output from the multiplier 16 to the image data M-Data of the current frame, to modulate the image data M_Data of the current frame, and supplying the modulated image data C_Data to the data driver 3.

The look-up table 14 stores the input image data M_Data on a per frame basis. The look-up table 14 also compares image data M_Data of the current frame supplied from the timing controller 5 with image data of the previous frame in units of at least one pixel, and outputting a prestored compensation value CV corresponding to a difference between the image data M_Data and the image data of the previous frame in units of at least one pixel.

The weight controller 12 continuously compares the image data M_Data sequentially input to the weight controller 12 with the predetermined reference data in units of at least one pixel. The weight controller 12 then counts the input number of low-grayscale image data having a lower grayscale value than that of the predetermined reference data, for detection of the input number of the low-grayscale image data. In this case, the weight controller 12 may execute the counting operation through comparison of the sequentially-input image data M_Data of the current frame with the predetermined reference data in units of a pixel block having a pixel size of "n×m", unlike the case in which the sequentially-input image data M_Data of the current frame is compared with the predetermined reference data on a per pixel basis (here, "n" and "m" may be equal or unequal natural numbers aside from "0").

Figure 3:
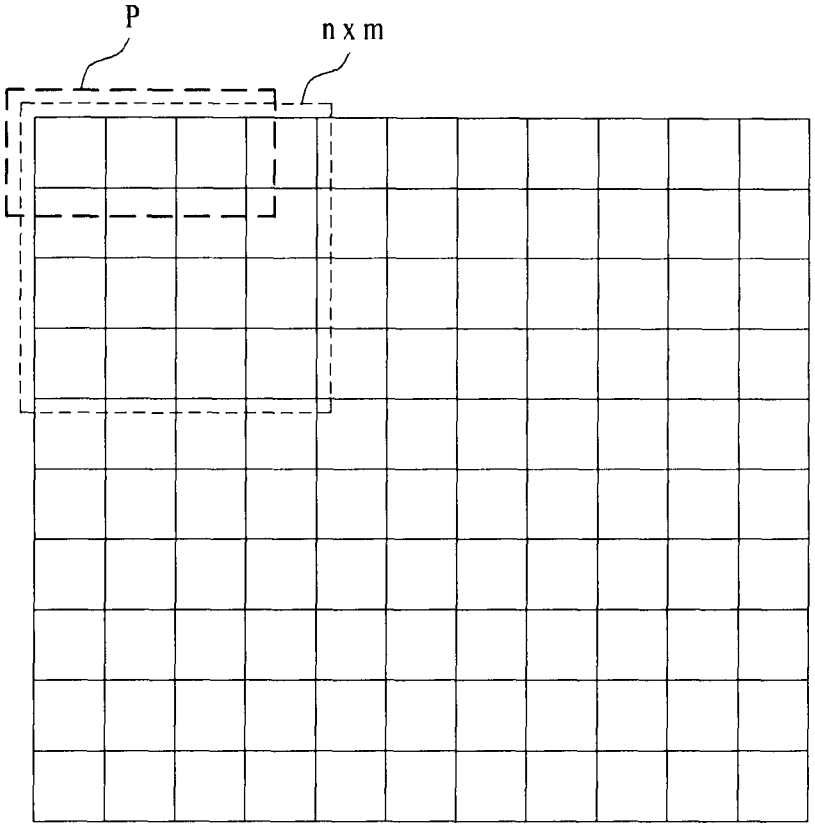
FIG. 3 is a diagram explaining an image data comparison method of a weight controller illustrated in FIG. 2.
Figure 4:
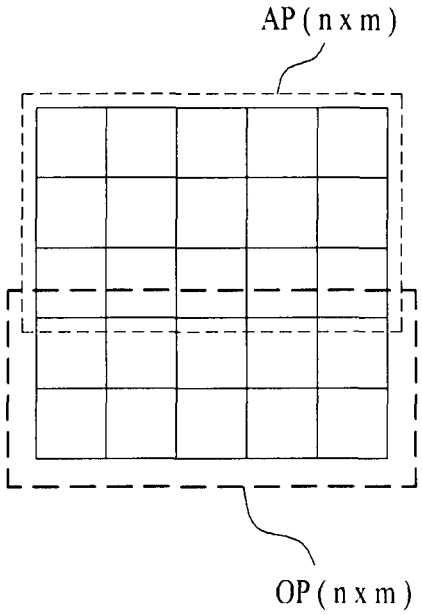
FIGS. 4-7 are diagrams explaining an image data comparison method of the weight controller illustrated in FIG. 2.

FIG. 3 is a diagram explaining an image data comparison method of the weight controller 12 illustrated in FIG. 2.

As shown in FIG. 3, the weight controller 12 may compare image data M_Data of the current frame sequentially input to the weight controller 12 with the predetermined reference data in on a per sub-pixel basis or on a per pixel basis. The weight controller 12 may then detect the accumulation number of input low-grayscale image data having a lower grayscale value than that of the predetermined reference data on a per pixel basis.

Alternatively, the weight controller 12 may compare the image data M_Data of the current frame with the predetermined reference data in units of one pixel block having a pixel size of "n×m". In this case, it may be possible to achieve a reduction in memory capacity and a reduction in memory use rate in accordance with the "n×m" pixel size of the pixel block.

Figure 5:
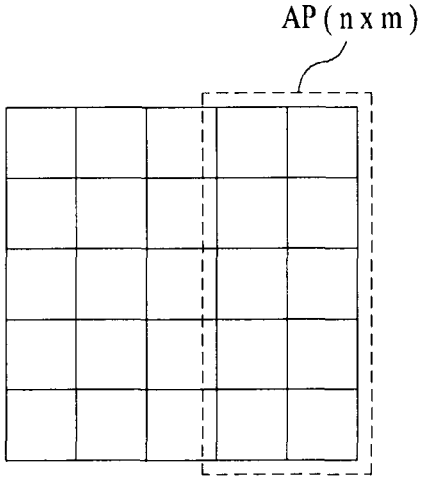
Figure 6:
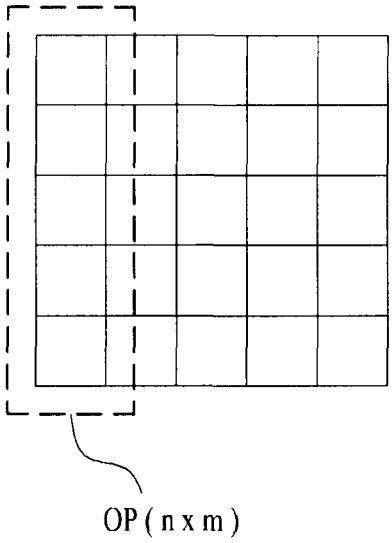
Figure 7:
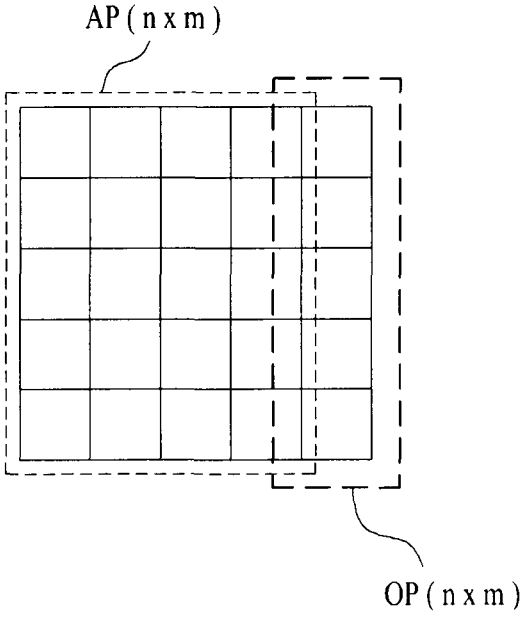

FIGS. 5-7 are diagrams explaining an image data comparison method of the weight controller illustrated in FIG. 2.

As illustrated in FIGS. 5-7, the weight controller 12 may count the accumulation number of low-grayscale image data for pixels at a particular position having influence on the image display characteristics of the current frame, through setting and comparison of only the pixels at the particular position. In other words, the weight controller divides pixels into those of a pixel region AP at a particular position having influence on the image display characteristics of the current frame and those of a pixel region OP at a position having no influence on the image display characteristics of the current frame. In this case, the weight controller 12 does not execute the comparison operation upon the entirety of the current frame or all pixels. In this case, the weight controller 12 may count the number of accumulations of low-grayscale image data for pixels in the pixel region AP having influence on the image display characteristics of the current frame. Accordingly, it may be possible to reduce the memory capacity and the use rate thereof in accordance with the size or number of pixel regions AP having influence on image display characteristics and the number of pixels included in the pixel regions AP.

Figure 8:
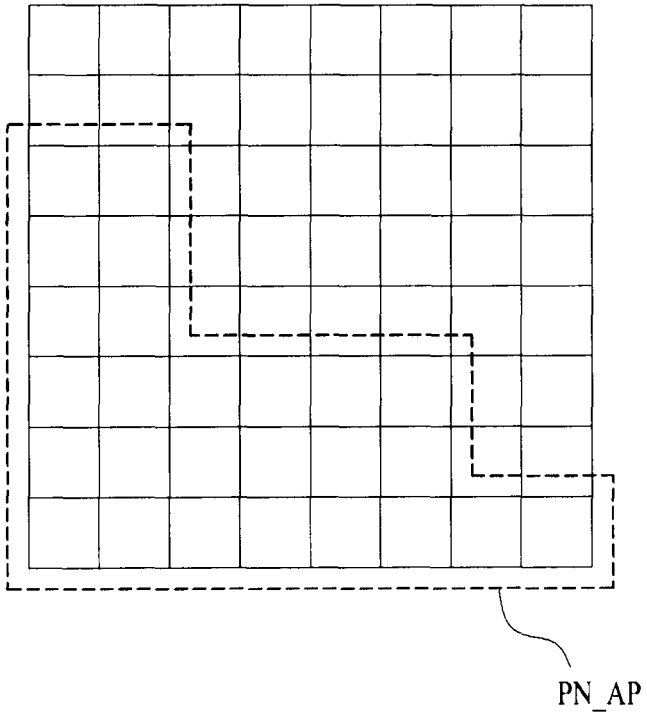
FIG. 8 is a diagram explaining another image data comparison method of the weight controller illustrated in FIG. 2.

FIG. 8 is a diagram explaining another image data comparison method of the weight controller illustrated in FIG. 2.

As shown in FIG. 8, the weight controller 12 does not execute the comparison operation upon the entirety of the current frame or all pixels. In this case, the weight controller 12 may set pixels in a predetermined particular pattern PN_AP. In this case, the weight controller 12 may execute a comparison operation only upon the pixels in the predetermined particular pattern PN_AP, to count the number of accumulations of low-grayscale image data in association with the pixels in the particular pattern PN_AP. In other words, the weight controller 12 may compare pixels in the pixel region AP at the predetermined particular position or the predetermined particular pattern PN_AP with the predetermined reference data, and may count the accumulation number of low-grayscale image data having a lower grayscale value than that of the predetermined reference data only in association with pixels to which the low-grayscale image data is input. In this case, it may be possible to reduce the memory capacity and the use rate thereof in accordance with the size or number of particular patterns PN_AP having influence on image display characteristics and the number of pixels included in each pattern PN_AP.

Particular patterns PN_AP or pixels at particular positions having influence on the image display characteristics of the current frame may be predetermined in accordance with a moving image, a still image, a text image, a high-contrast image, etc. Accordingly, the weight controller 12 may detect, from image data of each of the sequentially-input frames, data corresponding to the pixels at the predetermined particular positions or the predetermined patterns, and may count, on a per pixel basis, the accumulation number of pixels or patterns to which low-grayscale image data having a lower grayscale value than that of the predetermined reference data is input. Pixels which are not arranged at the predetermined particular positions or are irrespective of the particular patterns, namely, pixels other than pixels to be subjected to comparison may be set to a non-weighted value, namely, a value of "1".

Thus, the weight controller 12 compares image data of the current frame with reference data in units of at least one of one pixel, a pixel block having a pixel size of "n×m", pixels at a predetermined position, and a predetermined pattern. Thereafter, the weight controller 12 counts the accumulation number of low-grayscale image data, and then outputs a weight having a value corresponding to the counted value on a per pixel basis.

TABLE 1

| Accumulation Number | Weight (GV) |
|---|---|
| 3 | 1 |
| 4 | 1.02 |
| 5 | 1.04 |
| 6 | 1.06 |
| 7 | 1.08 |
| 8 | 1.10 |
| 9 | 1.12 |
| 10 | 1.14 |
| 11 | 1.16 |
| 12 | 1.18 |

The weight GV which corresponds to the accumulation number of low-grayscale image may be set in the weight controller 12 on a per pixel basis. As illustrated in Table 1, the weight GV may be set to have predetermined increments according to an increase in the accumulation number of low-grayscale image data, for application of a high degree of overdriving compensation. On the other hand, when the accumulation number of low-grayscale image data is decreased or there is no accumulation of low-grayscale image data, the weight GV may be set to be maintained or to have predetermined decrements, for application of a low degree of overdriving compensation.

The multiplier 16 multiplies compensation values CV of pixels sequentially output from the look-up table 14 by corresponding ones of weights GV output from the output controller 12, thereby sequentially outputting weight data C_CV. For pixels other than the pixels subjected to comparison in the weight controller 12, compensation values CV from the look-up table 14 are directly output as weight data C_CV because the weight of "1" is input. For the pixels subjected to comparison in the weight controller 12, values obtained by multiplying compensation values CV from the look-up table 14 by weights GV, respectively, are output as weight data C_CV.

The adder 18 sequentially adds the weight data C-CV sequentially output from the multiplier 16 to the sequentially-input image data M-Data of the current frame, to modulate the image data M_Data of the current frame. The image data C_Data modulated as described above is supplied to the data driver 3 in a sequential manner.

As apparent from the above description, the OLED display device according to the illustrated embodiment of the present invention may minimize required memory capacity and the use rate thereof while achieving an enhancement in display quality through adjustment of the degree of overdriving compensation in accordance with the number of accumulations of low-grayscale image data.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. An organic light emitting diode display device comprising: an image display panel comprising a plurality of pixel regions; a data driver for driving data lines of the image display panel; a timing controller for arranging image data input from outside of the organic light emitting diode display device to match a size of the image display panel, and generating a data control signal to control the data driver; and a data modulator for sequentially receiving image data of a current frame from the timing controller, counting a number of accumulations of pixels corresponding to image data at a particular position having a lower grayscale value than a grayscale value of predetermined reference data, generating modulated image data through application of a weight value determined in accordance with the counted accumulation number, and supplying the modulated image data to the data driver, wherein the data modulator includes a weight controller for comparing the image data supplied from the timing controller with the predetermined reference data in units of at least one pixel, wherein the comparison is of only the pixels at the particular position, counting an input number of low-grayscale image data having a lower grayscale value than the grayscale value of the predetermined reference data, and outputting the weight value set to correspond to the counted number on a per pixel basis.

2. The organic light emitting diode display device according to claim 1, wherein the data modulator further comprises:

a look-up table for comparing the image data supplied from the timing controller with image data of a previous frame, and outputting a compensation value corresponding to a difference between the image data from the timing controller and the image data of the previous frame in units of at least one pixel;

a multiplier for multiplying compensation values sequentially output from the look-up table by corresponding ones of the weight value output from the weight controller, thereby sequentially outputting weight data; and an adder for sequentially adding the weight data sequentially output from the multiplier to the image data of the current frame, to modulate the image data of the current frame, and supplying the modulated image data to the data driver.

3. The organic light emitting diode display device according to claim 2, wherein the weight controller compares the image data of the current frame with the predetermined reference data in units of at least one of one pixel, a pixel block having "n×m" pixels, pixels at a predetermined position, and a predetermined particular pattern, counts a number of accumulations of low-grayscale image data having a lower grayscale value than the grayscale value of the predetermined reference data, and outputs the weight value corresponding to the counted number on a per pixel basis.

4. The organic light emitting diode display device according to claim 3, wherein:

when the accumulation number of the image data having a lower grayscale value than the grayscale value of the predetermined reference data is increased, the weight value is set to have predetermined increments according to the increased accumulation number, for application of a high degree of overdriving compensation; and when the accumulation number of low-grayscale image data is decreased or there is no accumulation of low-grayscale image data, the weight value is set to be maintained or to have predetermined decrements, for application of a low degree of overdriving compensation.

5. A method for driving an organic light emitting diode display device, comprising: driving data lines of an image display panel including a plurality of pixel regions; arranging image data input from outside of the organic light emitting diode display device to match a size of the image display panel, and generating a data control signal to control a data driver; and sequentially receiving image data of a current frame, counting a number of accumulations of pixels corresponding to image data at a particular position having a lower grayscale value than a grayscale value of predetermined reference data, generating modulated image data through application of a weight value determined in accordance with the counted accumulation number, and supplying the modulated image data to the data driver, wherein generating the modulated image data comprises comparing the image data of the current frame at the particular position with the predetermined reference data, wherein the comparing is of only the pixels at the particular position, counting an input number of low-grayscale image data having a lower grayscale value than the grayscale value of the predetermined reference data, and outputting the weight value to correspond to the counted number on a per pixel basis.

6. The method according to claim 5, wherein the modulated image data further comprises:

comparing the image data of the current frame with image data of a previous frame, and outputting a compensation value corresponding to a difference between the image data of the current frame and the image data of the previous frame in units of at least one pixel;

multiplying sequentially-output compensation values by corresponding ones of the weight value output on a per pixel basis, thereby sequentially outputting weight data; and sequentially adding the sequentially-output weight data to the image data of the current frame, to modulate the image data of the current frame, and supplying the modulated image data to the data driver.

7. The method according to claim 6, wherein the outputting the weight value on a per pixel basis comprises:

comparing the image data of the current frame with the predetermined reference data in units of at least one of one pixel, a pixel block having "n×m" pixels, pixels at a predetermined position, and a predetermined particular pattern, and counting a number of accumulations of low-grayscale image data having a lower grayscale value than the grayscale value of the predetermined reference data; and outputting the weight value corresponding to the counted number on a per pixel basis.

8. The method according to claim 7, wherein:

when the accumulation number of the image data having a lower grayscale value than the grayscale value of the predetermined reference data is increased, the weight value is set to have predetermined increments according to the increased accumulation number, for application of a high degree of overdriving compensation; and when the accumulation number of low-grayscale image data is decreased or there is no accumulation of low-grayscale image data, the weight value is set to be maintained or to have predetermined decrements, for application of a low degree of overdriving compensation.

* * * * *